United States Patent [19]

Honda et al.

[11] Patent Number: 4,783,678

[45] Date of Patent: Nov. 8, 1988

[54] RECORDING APPARATUS

[75] Inventors: Hiroyuki Honda, Hachioji; Takashi Tamura, Higashimine; Takayoshi Hashimoto, Hachioji, all of Japan

[73] Assignee: Konishiroku Photo Industry Co., Ltd., Tokyo, Japan

[21] Appl. No.: 890,061

[22] Filed: Jul. 24, 1986

[30] Foreign Application Priority Data

Jul. 27, 1985 [JP] Japan ..... 60-166188
Aug. 29, 1985 [JP] Japan ..... 60-190384

[51] Int. Cl.[4] ..... G03G 15/00
[52] U.S. Cl. ..... 355/3 SH; 355/3 R
[58] Field of Search ..... 355/3 R, 3 DR, 3 SH, 355/14 SH

[56] References Cited

U.S. PATENT DOCUMENTS 3,966,316 6/1976 Pfeifer et al. ..... 355/3 DR
4,300,710 11/1981 Du Bois et al. ..... 355/14 SH X
4,335,950 6/1982 Gunzelmann et al. ..... 355/3 R
4,531,823 7/1985 Deguchi et al. ..... 355/3 SH X
4,545,668 10/1985 Zaitsu ..... 355/3 R
4,551,000 11/1985 Kanemitsu et al. ..... 355/3 R
4,629,307 12/1986 Miyai et al. ..... 355/3 R
4,635,010 1/1987 Miyai et al. ..... 355/3 R
4,660,963 4/1987 Stemmle ..... 355/3 SH X

FOREIGN PATENT DOCUMENTS 6048067 3/1985 Japan ..... 355/3 DR

*Primary Examiner*—Arthur T. Grimley
*Assistant Examiner*—Jane K. Lau
*Attorney, Agent, or Firm*—Jordan B. Bierman

[57] ABSTRACT

A recording apparatus wherein a bottom of a body of the apparatus having conveyor device for conveying recording paper is freely opened and closed to open the conveyor device when the body is lifted up. A body frame composed of a front panel, a rear panel and a bottom plate of the recording apparatus is molded by a resin as a unit.

11 Claims, 3 Drawing Sheets

RECORDING APPARATUS

BACKGROUND OF THE INVENTION

1. Field of the Invention

The present invention generally relates to a recording apparatus such as an electrophotographic reproducing machine, and in particular, to a recording apparatus wherein it is possible to easily open the interior of the apparatus if troubles such as paper jamming should occur therein.

2. Description of the Prior Art

In general, a conventional type of electrophotographic reproducing machine is arranged in such a manner that, after paper has been fed into the interior of the machine, an image is recorded on the paper, and the paper is discharged. If the paper jams while it is being fed, namely, if paper jamming occurs in the interior, the body is opened so as to remove the jammed paper.

Heretofore, the following two types of recording apparatus have been available. One is a clam shell type of apparatus having a body which can be vertically divided and the other is SHUTTLEX 850 (tradename registered by Sanyo Electric Co., Ltd.) which is arranged such that a fixing unit, a paper feed unit and so forth are moved in parallel to each other in the direction away from a photosensitive drum for the purpose of obtaining a space for removing jammed paper. However, the former clam shell type involves disadvantage in that a large number of parts are required and a long man-hour is needed, resulting in an increase in costs. Similarly, the latter "SHUTTLEX" type requires a large number of parts and more man-hours for assembly, thus leading to complexity in adjustment and an increase in cost as well as inferior operability.

The reproducing apparatus generally used in office work commonly has a rectangular parallelepiped configuration so as to efficiently utilize a space during the conveyance and in the installation of the apparatus. Therefore, the framework of the apparatus is constituted by a body frame wherein front and rear panels are connected to a bottom plate, and each panel which is mounted on the left and right side of the frame so as to form a paper discharging section and a paper feeding section, a document glass plate being laid on the upper opening of the frame. Such a body frame has heretofore been formed in such a manner that, after each of the panels and the bottom panel which are individually worked has been subjected to surface treatment, the treated panels are integrally assembled by bolting or caulking spot welding.

In such a prior art, it is necessary to mount on the body frame of the reproducing apparatus a mounting reference member, a guide member and so forth in addition to the above-described document glass plate, for the purpose of mounting an optical system and an image forming section. However, since the body frame is made of a metal sheet, it is impossible to integrally form all the panels of the body frame.

For this reason, the above-mentioned mounting reference member and the guide member have to be individually produced and fixedly added to the body frame. In consequence, the production of the body frame requires a large number of parts and many man-hours, thereby lowering the yield of the production of articles, thus resulting in occupying a large percentage of the price of the reproducing apparatus.

SUMMARY OF THE INVENTION

Accordingly, it is an object of the present invention to provide a recording apparatus which solves the above-described problems of the prior art and wherein the number of parts and costs are reduced, whereby it is possible to positively obtain a sufficient working space and to reduce the overall size of the apparatus.

It is another object of the present invention to provide a recording apparatus wherein each of the front panel, the rear panel and the bottom plate do not have to be assembled into the body frame, and in addition, it is possible to form the above-described mounting reference member and the guide member integrally with the body frame.

To achieve the first object, the recording apparatus having conveyor means wherein an image is recorded while said conveyor means is conveying recording paper, and a bottom of a body of the apparatus can be freely opened and closed.

To achieve the second object, the reproducing apparatus comprises a body frame composed of a front panel, a rear panel and a bottom plate which are integrated into a resin molding.

The above and other objects, features and advantages of the present invention will become apparent from the following description of the preferred embodiment thereof, taken in conjunction with the accompanying drawings.

DESCRIPTION OF THE PREFERRED EMBODIMENTS

Figure 1:
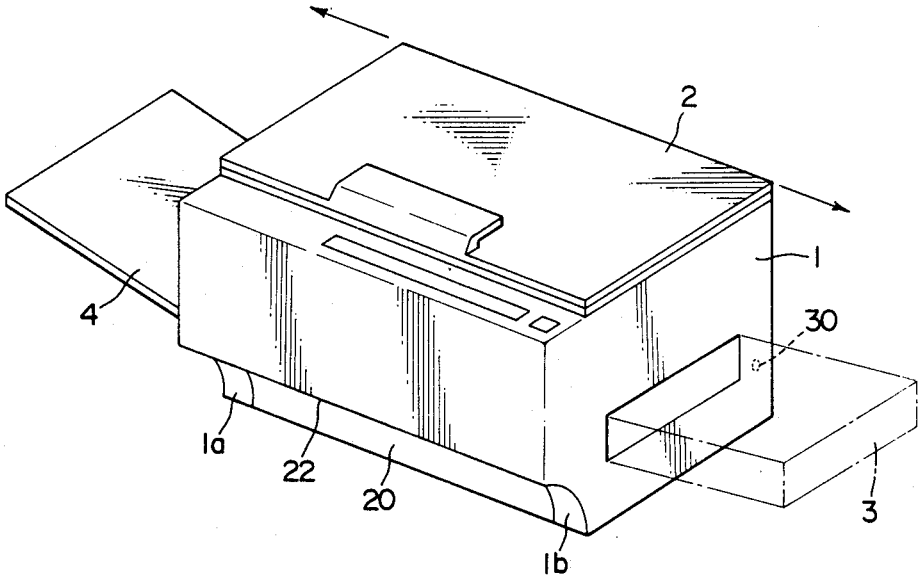
FIG. 1 is a diagrammatic perspective view of a preferred embodiment of the recording apparatus of the present invention.
Figure 2:
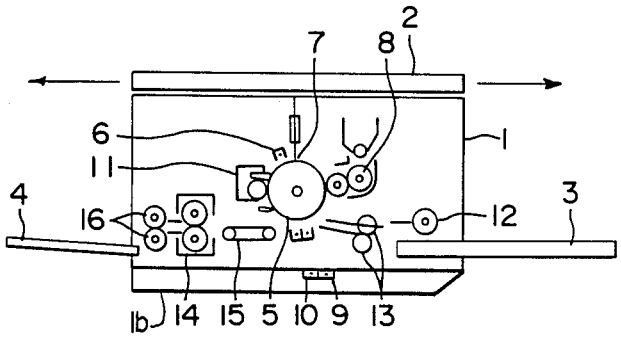
FIG. 2 is a front elevational view of the apparatus.

Referring to FIGS. 1 and 2 showing a preferred embodiment of the recording apparatus of this invention, a body 1 has a document glass plate and a platen cover 2 on its upper side, and a paper feed cassette 3 is detachably attached to one side of the body 1 while a discharge tray 4 is located on the other side of the body 1.

The body 1, in its interior, includes a photosensitive drum 5 serving as an image retainer and an electrostatic charger 6 is disposed in close proximity of and in face-to-face relationship with the upper portion of the photosensitive drum 5. Furthermore, an exposure section 7, a developer 8, a transfer electrode 9, a separating electrode 10 and a cleaner 11 are arranged in this order from the electrostatic charger 6 along the vicinity of and in face-to-face relationship with the periphery of the photosensitive drum 5 in the direction of the rotation of the photosensitive drum 5.

Also, a paper feed roller 12 is disposed on the upper side of the paper feed cassette 3 in such a manner that the roller 12 adjoins the upper surface of the uppermost sheet of the paper stacked in the cassette 3 for a sequential feed operation. A sheet of the paper is fed by the roller 12, and is in turn conveyed to the gap between the transfer electrode 9 and the photosensitive drum 5 through a pair of register rollers 13 constituted by upper and lower members as viewed in the Figure. Also, a conveyor unit 15 is interposed between the separating electrode 10 and a fixing unit 14, and a pair of discharge rollers 16 composed of upper and lower members as viewed in the Figure is disposed on the side of the fixing unit 14 which is closer to the discharge tray 4.

On the other hand, the body 1 has a bottom portion 20 at its lower position, and the bottom portion interposed between both side portions 1*a*, 1*b* of the body 1 is journaled (30) to the rear side portion of the body 1 in such a manner as to be capable of opening the body 1.

Figure 6:
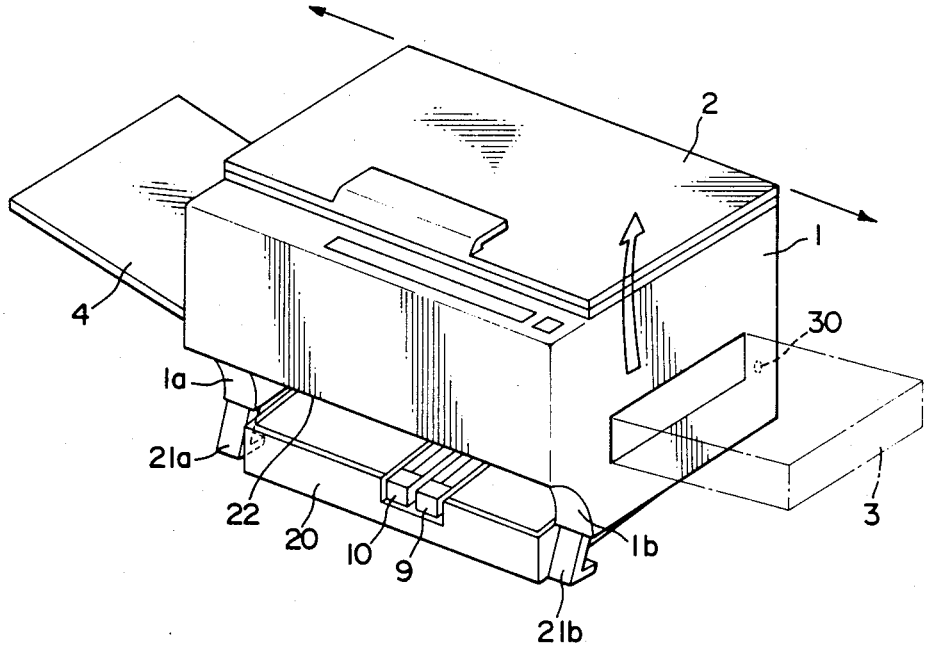
FIG. 6 is a diagrammatic perspective view similar to FIG. 1 of the recording apparatus, showing that the body thereof is opened.
Figure 4:
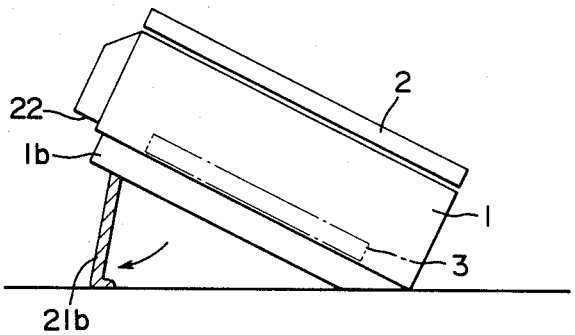
FIGS. 4 and 5 are respectively side elevational views of the apparatus, diagrammatically illustrating that the body of the apparatus is opened.
Figure 5:
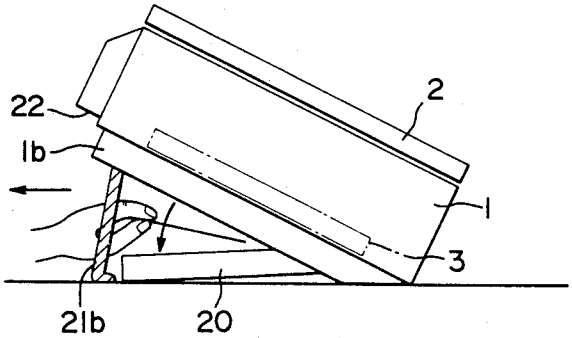

As shown in FIGS. 4, 5 and 6, leg members 21*a*, 21*b* are disposed so that it may be drawn out of the lower portions of the front sides of the side portions 1*a*, 1*b*.

The transfer electrode 9, the separating electrode 10, the conveyor unit 15 and so forth are disposed in the bottom portion 20 of the body 1. It is possible to arrange the paper feed portion such as the paper feed roller and fixing unit 14 on the bottom portion 20. The operation of each constituent elements will be explained hereinunder.

The paper feed roller 12 feeds the uppermost sheet of the paper stacked in the paper feed cssette 3, and reaches the pair of upper and lower register rollers 13. After the sheet has been further fed through the register roller pair 13 at a predetermined timing, it reaches the position between the photosensitive drum 5 and the transfer electrode 9.

In the meantime, a toner image corresponding to the original image is formed on the photosensitive drum 5 by means of the developer 8 and so forth, so that the toner image is positioned in correspondence with and in face-to-face relationship with the printing surface of the conveyed sheet. After the toner image has been transferred onto the sheet by the transfer electrode 9, the sheet is separated from the drum 5 by the separating electrode 10 and is in turn conveyed to the fixing unit 14 through the conveyor means 15. In the fixing unit 14, the toner image is fixed to the surface of the sheet, and the treated sheet is caused to pass through the pair of upper and lower discharge rollers 16, thus being discharged into the discharge tray 4 attached to the side of the body 1 opposing the paper feed cassette 3.

Figure 3:
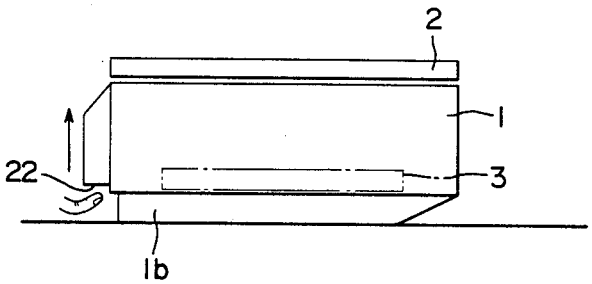
FIG. 3 is a side elevational view of the apparatus, illustrating how to raise the body of the apparatus.

During the above-described operation, if paper jams into the interior of the body 1, an operator, as shown in FIG. 3, raises the body 1 upwardly, with his/her fingers placed at a lip 22 formed on the front side of the body 1.

In this fashion, after the front side of the body 1 has been upraised, the front side of the body 1 is inclined upwardly with the rear side as a fulcrum, and in an interlocking relationship with the upraising operation, the leg members 21*a*, *21b* disposed in the lower portion of the front side of the side portions 1*a*, 1*b* of the body 1 project downwardly with the front side as a fulcrum, whereby the body 1 is held in a state shown in FIGS. 4 to 6 even if the operator separates his/her fingers from the front side of the body 1.

Subsequently, when the front side of the bottom portion 20 is preased downwardly, the bottom portion 20 is moved downwardly so as to expose the interior of the body 1 since the bottom portion 20 is journaled (30) to the body 1 with the rear side thereof as a fulcrum.

After the disposal of paper jamming in the interior has been completed in this state, the operator slightly upraises the body 1 again by using the lip 22 of the body 1 and the above-described leg members 21*a*, 21*b* are drawn into the side portions 1*a*, 1*b*. Thereafter, the body 1 is horizontally placed and the operation is completed. That is, the bottom portion 20 can be swung centering about a line of the paper feed direction. This oonstruction is simple and preferable than a case centering about a line normal to the paper feed direction. The leg member is not alway necessary, but preferable because it is difficult to support by hand when jamming handling time is too long.

While the above-mentioned embodiment is arranged such that the leg members 21*a*, 21*b* are manually projected downwardly, the embodiment is only illustrative, and may be arranged such that the leg members 21*a*, 21*b* automatically project when the body 1 is raised upwardly. Also, the bottom portion 20 may be moved downwardly by utilizing the fact that the portion 20 naturally moves downwardly in an interlocking relationship with the upraising of the body 1, thereby exposing the interior of the body 1, and the bottom portion 20 may also be unlocked by hand and be caused to drop downwardly, thereby exposing the interior of the body 1.

As will be understood by those skilled in the art, since the present invention has the above-described construction, the number of parts and costs can be reduced, thereby remarkably easily opening the body. In addition, the opening operation can be performed merely by upraising the body, so that this invention possesses advantage in that it is suited for a small-size recording apparatus.

As compared with the half-sectioned type which has currently been put into practice, the size of the opening portion of the body of the reproducing machine according to this invention can be reduced to the minimum. Therefore, the operator never touches an electric power source or a charging section which is provided in the interior of the reproducing machine, whereby he/she can operate the machine in safety. In addition, since the degree of opening the conveyor means is large, the present invention further possesses an advantage in that operability is remarkably efficient even when paper jams in the interior of the apparatus.

Figure 7:
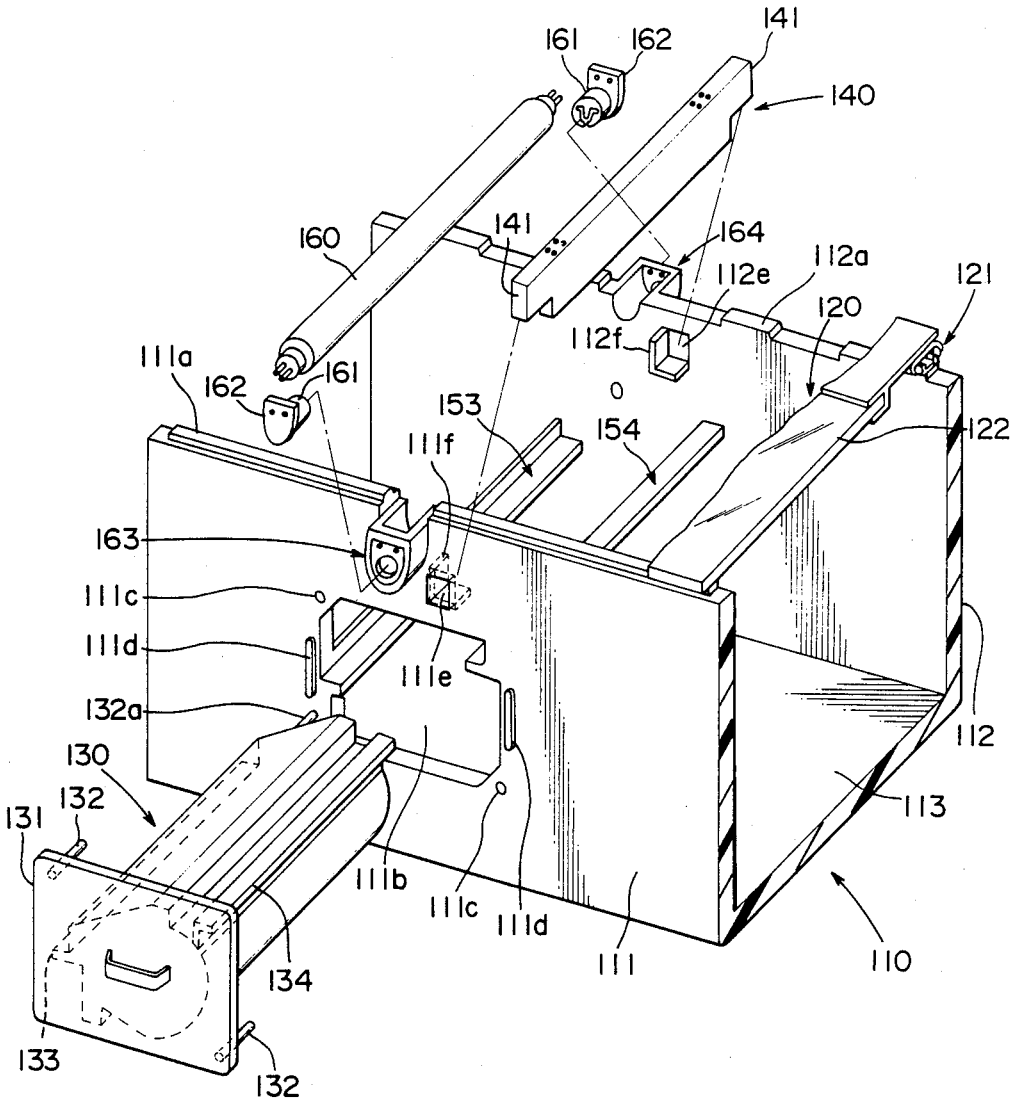
FIG. 7 is a diagrammatic perspective view of a body frame which is applied to the recording apparatus of this invention.

FIG. 7 diagrammatically shows the construction of a body frame 110 incorporated in the reproducing apparatus according to this invention and the structural relationship between the body frame 110 and members mounted thereon.

The body frame 110 is constituted in such a manner that a front panel 111 and a rear panel 112 are connected to each other integrally by a bottom plate 113, by using a synthetic resin material having a high thermal resistance and a large mechanical strength such as a PPO (polyphenylene oxide) resin or an ABS resin (any copolymer of acrylonitrile, butadiene, and styrene) including glass fiber.

A plurality of document glass plate mounting surfaces 112*a* are formed along the upper end of the rear panel 112, the surfaces 112*a* serving as a reference surface with respect to a rail member 121 for guiding the travel of a glass sheet 122 of a document glass plate 120. On the other hand, a sliding surface 111*a* is formed along the upper end of the front panel 111, the surface 111*a* serving as a reference surface on which the glass sheet 122 is slidably laid.

Specifically, the document glass plate 120 is constituted in such a manner that the rail member 121 is mounted directly on the document glass plate mounting surfaces 112*a* of the body frame 110, without any other member being interposed therebetween, and the glass sheet 122 is also laid directly on the sliding surface 111*a* of the frame 110. When power is transmitted from the power source of the reproducing apparatus to the document glass plate 120, the document glass plate 120 is caused to travel along the rail member 121 as a guide means over the sliding surface 111*a*, so that it is possible to expose the original to light in a scanning manner.

An opening 111*b* in which an image forming member 130 is formed substantially in the center of the front panel 111, the image forming member 130 being constituted in the form of a unit which is separated from the body of the reproducing apparatus and detachably incorporated in the body.

The image forming member 130 is constituted by a cylindrical vessel accommodating a photosensitive drum, an charging electrode, a nail for separating recording paper from the drum and a cleaner, separately from a developing unit, When the image forming member 130 is inserted into the body frame 110 through the inserting hole 111*b*, it is mechanically and electrically connected to the reproducing apparatus and carries out a part of the process of the formation of an image for reproduction. The developer may be integral with the image forming member 130.

Three guide holes 111*c*, 111*c* and 111*e* are formed in the vicinity of the inserting hole 111*b* of the front panel 111 as a reference means used in incorporating the image forming section 130 in the body frame 110. Guide pin 132 projecting from the back of a flange portion 131 and another guide pin 132*a* are respectively inserted in the guide holes 111*c*, 111*c* and 111*e*. Thereby, the image forming member 130 can be remarkably precisely inserted in an appropriate position within the body frame 110. On the other hand, the position of the end adjacent to the rear panel 112 is controlled by bringing the back of the flange portion 131 into contact with a pair of ridges 111*d* formed on the right and left sides of the inserting hole 111*b* of the front panel 111. In consequence, the above-described mechanical and electrical connections can be suitably achieved by these mounting reference means.

Rectangular holes 111*e*, 112*e* as reference holes are respectively formed in the positions of the front and rear panels 111, 112 which are just above the image forming member 130, the rectangular holes 111*e*, 112*e* receiving both ends 141, 141 of an optical system 140 accommodating a convergent light transmitting means. Support members 111*f* and 112*f* are respectively provided at two of the four sides of the rectangular holes 111*e* and 112*e* in each of the inner sides of the front and rear panels 111, 112, each member being formed in the shape of L opposing each other.

Hence, both ends 141 of the optical system 140 are placed against the support members 111*f*, 112*f* and two surfaces of each of the ends 141 are made to fixedly adjoin the reference surfaces of the support member 111*f* 112*f*. The image of the original is properly focused on the periphery of the photosensitive drum within the image forming member 130 through the convergent light transmitting means.

Guide rails 153, 154 are bridged integrally between the front and rear panels 111, 112 in order to guide the image forming member 130 along supporting projections 133, 134 thereof when inserting and removing the image forming member 130 in and out of the body frame 110, and the guide rails 153, 154 support the weight of the image forming member 130 to thereby reduce the labor of the operator.

Holder portions 163, 164 are formed integrally on the upper ends of the front and rear panels 111, 112 so as to project outwardly from the panels. Support members 162, 162 having sockets 161 for receiving an illuminating exposure lamp are fitted into the holder portions 163, 164 from the exterior, whereby it is possible to provide the sockets 161, 161 on the inner sides of the body frame 110 in face-to-face relationship with each other. Therefore, the illuminating exposure lamp 160 can be positioned in such a manner that it is possible to accurately illuminate the surface of the original incorporated in the optical system 140. It should be noted that various other means (not shown in the drawing) such as a paper feed device, transfer and separation devices, conveyor device and a fixing device can be disposed in the body frame 110.

As will be understood by those skilled in the art, the present invention possesses the following advantages.

In the illustrated preferred embodiment, since the body frame 110 is integrally formed of resin, it is possible to remarkably accurately determine the positional relationship between the document glass plate 120 and the optical system constituted by the convergent light transmitting means 141, thereby preventing a defect in an image from being formed by the imbalance in adjustment of the distance between the transmitting means 141 and the dooument glass plate 120, which is a characteristic of the convergent light transmitting means 141. Furthermore, the distance between the convergent light transmitting means 141 and the image forming member 130 is exactly determined without adjustment, so that a stable image can be obtained. Further, the distance between the transfer portion and the photosensitive drum can be determined without adjustment, because the paper feeding portion and the transfer portion are mounted on the frame body as a unit. The body frame used in a reproducing apparatus has reference surfaces suited for each constituent element or unit to be mounted on the body frame, and it is possible to integrally form the support members and the guide members which an operator heretofore has to assemble with labor. In consequence, the present invention successfully eliminates a large number of relay parts, support or guide members which are required for mounting each member or unit, whereby assembly, in particular, automatic assembly can be simplified, and low-cost, compact reproducing apparatus can be provided.

What is claimed is:

1. A recording apparatus having a body frame with a top portion, a bottom portion, and side walls forming a rectangular enclosure, a document exposure section for exposing a document, a photosensitive section for forming a latent image of an exposed document, and a developer section for developing a latent image formed on the photosensitive section, all of the above-mentioned sections being mounted within the enclosure to the side walls of the body frame, said apparatus further having a paper feed section in the body frame for feeding a paper sheet along a conveyance path in a longitudinal direction of the body frame, a transfer section for transferring a developed latent image on the photosensitive section to a paper sheet in contact with the photosensitive section, a separating section for separating a paper sheet having a transferred image thereon from the photosensitive section, a fixing section for fixing a transferred image on a paper sheet conveyed thereto, and a discharge section for discharging a paper sheet having a copy image fixed thereon through one side wall of the body frame, wherein the improvement comprises:

said side walls of the body frame including a front side wall and rear side wall, which are disposed on opposite sides from each other along a facing direction perpendicular to the longitudinal direction, and means for holding the apparatus which is upwardly pivotted along a fulcrum formed by a bottom edge of said rear wall, said means being pivotably mounted to a front bottom part of said body frame.

2. A recording apparatud according to claim 1, wherein said improvement includes leg members disposed along the front side wall which are drawn out to support the body frame when it is pivoted to a pivoted position.

3. A recording apparatus according to claim 1, wherein said improvement further comprises at least said transfer section, separating section, and conveying section being mounted on the bottom portion of the body frame, and the bottom portion being journalled to the rear side wall such that it can be opened downward from the body frame when the body frame is in the upward pivoted position.

4. A recording apparatus according to claim 3, wherein said improvement further comprises said paper feed section and fixing section also being mounted on the bottom portion.

5. A recording apparatus according to claim 1, wherein said improvement further comprises said body frame being integrally molded of resin material.

6. A recording apparatus according to claim 5, wherein upper edges of the front and rear side walls form guide surfaces for movement of the platen disposed to be movable therealong in the longitudinal direction for exposing a document placed on the platen.

7. A recording apparatus according to claim 5, wherein the front side wall is provided with a central opening for inserting into the body frame the developing section and photosensitive section combined together into a replaceable image forming unit.

8. A recording apparatus according to claim 7, wherein the front side wall is provided with mounting reference surfaces around the central opening, and the replaceable image forming unit is provided with corresponding mounting engagement means for engaging the mounting reference surfaces to accurately position the unit in the opening.

9. A recording apparatus according to claim 5, wherein the exposure section includes an exposure lamp and a convergent light transmitting means both formed as elongated sections in that facing direction, and the front and rear side walls are formed with sockets for mounting the ends of the exposure lamp and light transmitting means.

10. A recording apparatus according to claim 1 further comprising a paper supply section provided through another side wall of the body frame opposite the one side wall in the longitudinal direction for supplying paper to said paper feed section.

11. A recording apparatus according to claim 1 further comprising a document platen provided on the top portion of the body frame.

* * * * *